US006196807B1

(12) United States Patent
Wu

(10) Patent No.: US 6,196,807 B1
(45) Date of Patent: Mar. 6, 2001

(54) PRESSURE GAUGE OF A BICYCLE TIRE PUMP WITH ACCURATE INDICATION

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/451,603

(22) Filed: Nov. 30, 1999

Related U.S. Application Data

(63) Continuation-in-part of application No. 09/126,499, filed on Jul. 30, 1998, now abandoned.

(51) Int. Cl.[7] ..... F04B 49/00
(52) U.S. Cl. ..... 417/63; 417/313; 73/146.8
(58) Field of Search ..... 417/63, 313; 73/146.8, 73/146.5, 746, 753

(56) References Cited

U.S. PATENT DOCUMENTS 4,919,600 * 4/1990 Yang ..... 417/63
5,503,012 * 4/1996 Rabizadeh ..... 73/146.8
5,779,457 * 7/1998 Chuang et al. ..... 417/467

* cited by examiner

*Primary Examiner*—Teresa Walberg
*Assistant Examiner*—Jeffrey C Pwu
(74) *Attorney, Agent, or Firm*—Charles E. Baxley

(57) ABSTRACT

A pressure gauge of a tire pump includes a chamber communicated with the chamber and a pressure indicator is movably received in the chamber. The pressure indicator has a tube with a head portion attached to a first end thereof and a receptacle defined in a second end thereof. The head portion is in slidable contact with an inner periphery of the chamber and the tube is not in contact with the inner periphery of the chamber. A first rotational member is rotatably mounted to an end wall defining the receptacle of the tube. A second rotational member is rotatably mounted to the end member. A spring has a first end securely attached to the first rotational member to move therewith and a second end securely attached to the second rotational member to rotate therewith. Thus, rotational effect of the spring during movement of the pressure indicator is eliminated to provide accurate tire pressure indication.

19 Claims, 3 Drawing Sheets

PRESSURE GAUGE OF A BICYCLE TIRE PUMP WITH ACCURATE INDICATION

CROSS REFERENCE TO RELATED APPLICATION

This is a continuation-in-part application of U.S. Pat. No. 09/126,499 filed on Jul. 30, 1998, which is now abandoned.

FIELD OF THE INVENTION

The present invention relates to a pressure gauge, and more particularly, to a pressure gauge of a bicycle tire pump, the pressure gauge having a tubular pressure indicator with a rubber made head portion attached thereto, wherein the head portion is slidably received in a chamber for the gauge and the pressure indicator is not in contact with an inner periphery defining the chamber so as to have less friction therebetween for providing accurate tire pressure indication.

BACKGROUND OF THE INVENTION

U.S. Pat. No. 5,503,012 to Rabizadeh issued on Apr. 2, 1996 discloses a tire pressure monitoring device that includes a ball disposed within a tube which has an opening, at one end, in communication with the interior of the tire. The tube has a transparent window along its length to allow the position of the tire pressure ball to be visualized. The transparent window has graduations, calibrated to allow the tire pressure to be determined by the position of the ball. Nevertheless, reading of the tire pressure among the indicia is not easy, and an unskilled user may report a wrong tire pressure. In addition, the indicia on the transparent window tend to wear out after a term of use. In addition, the compression spring for attaching the ball is more or less rotated during movement of the ball due to the helical configuration of the compression spring. Namely, unexpected rotational movement of the compression occurs and thus affects the pressure indication accuracy.

U.S. Pat. No. 4,919,600 to Yang issued on Apr. 24, 1990 discloses a tire pump with a pressure gauge including a cylinder having a piston head slidably provided in the cylinder. A pressure measuring device with a pressure indicating element is disposed at a front end of the cylinder so that the pressure indicating element is readable through a peep hole in the cylinder. The pressure measuring device interconnects an outlet of the cylinder. A bypass tube with a check valve is disposed beside the pressure measuring device so that air pressurized by the piston head flows out from the outlet through the bypass tube. The pressurized air also flows through air holes in order that the pressure within the pumped tire can be read from the pressure indicating element of the pressure measuring device through the peep hole. Again, the compression spring for attaching the pressure indicating element is more or less rotated during movement of the pressure indicating element due to the helical configuration of the compression spring. Unexpected rotational movement of the compression occurs and thus affects the pressure indication accuracy. The pressure indicating element includes a scale attached to a piston, wherein the scale tends to break during use, and the manufacture cost for such a pressure indicating element is relatively high.

FIG. 1 of the drawings illustrates another conventional arrangement of a pressure indicator 50 that is square in section and is slidably received in a chamber 51 with square section. The pressure indicator 50 has pressure indicia marked on an outer periphery thereof for indicating the tire pressure. However, the friction between the pressure indicator 50 and the chamber 51 is so large such that the pressure indicated by the pressure indicator 50 is not precise.

The present invention intends to provide a pressure gauge that may provide accurate tire pressure indication.

SUMMARY OF THE INVENTION

In accordance with a first aspect of the invention, a pressure gauge of a tire pump comprises:

a member adapted to be attached to the tire pump and defining a chamber therein, the chamber having a first end which is sealed by an end member, the chamber further having a second end adapted to communicate with said tire pump, a window being defined in the member, and a pressure indicator having a tube with a head portion attached to a first end thereof and a receptacle defined in a second end thereof, indicia being provided around an outer periphery of said tube so as to be seen via said window, a spring being received in the chamber and attached between said end member and an end wall defining said receptacle, said head portion being in slidable contact with an inner periphery of said chamber, and an annular gap being defined between said tube and said inner periphery of said chamber.

Preferably, the tube has a circular outer periphery. A first rotational member is rotatably mounted to the end wall defining the receptacle of the tube. The spring includes an end securely attached to the rotational member to move therewith. The end wall defining the receptacle of the tube has a first notch defined therein. The first rotational member includes a first tip portion rotatably received in the notch. The first rotational member may include a compartment for securely receiving the end of the spring. An annular gap is defined between the first rotational member and an inner periphery of the tube.

A second rotational member is rotatably mounted to the end member. The other end of the spring is securely attached to the second rotational member to rotate therewith. The end member has a second notch defined in an end facing the tube. The second rotational member has a second tip portion rotatably received in the second notch. The second rotational member may include a compartment for securely receiving the other end of the spring.

The first end of the tube includes an engaging member extended therefrom for securely engaging with the head portion. The head portion has a slit, and the engaging member has a neck from which an enlarged head extends. The neck is securely received in the slit, and the enlarged head is retained in the head portion by engaging with an inner periphery of the head portion.

In accordance with a second aspect of the invention, a pressure gauge of a tire pump comprises:

a member adapted to be attached to the tire pump and defining a chamber therein, the chamber having a first end which is sealed by an end member, the chamber further having a second end adapted to communicate with said tire pump, a window being defined in the member and having indicia provided thereon, and a pressure indicator having a tube with a head portion attached to a first end thereof and a receptacle defined in a second end thereof, a line being provided on an outer periphery of said tube so as to be seen via said window for indicating tire pressure, a spring being received in the chamber and attached between said end member and an end wall defining said receptacle, said head portion being in slidable contact with an inner periphery of said chamber, and an annular gap being defined between said tube and said inner periphery of said chamber.

By such an arrangement, when the pressure indicator is moved in the chamber, the only friction is happened between the head portion and the inner periphery of the chamber. The two rotational members may rotate about the two respective tip portions when the spring is compressed so that rotational effect of the spring is eliminated. Therefore, the less friction between the pressure indicator and the inner periphery of the chamber and elimination of the rotational effect of the spring increase tire pressure indication accuracy.

Further objects, advantages, and features of the present invention will become apparent from the following detailed description with appropriate reference to the accompanying drawings.

DETAILED DESCRIPTION OF THE PREFERRED EMBODIMENTS

Figure 5:
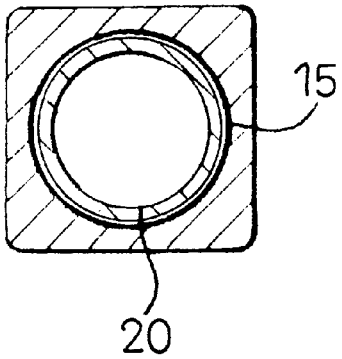
FIG. 5 is a sectional view taken along line 5—5 in FIG. 4.
Figure 1:
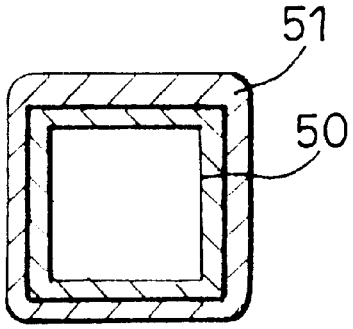
Fig 1 PRIOR ART
FIG. 1 is a schematic sectional view of a conventional pressure gauge of a tire pump.
Figure 2:
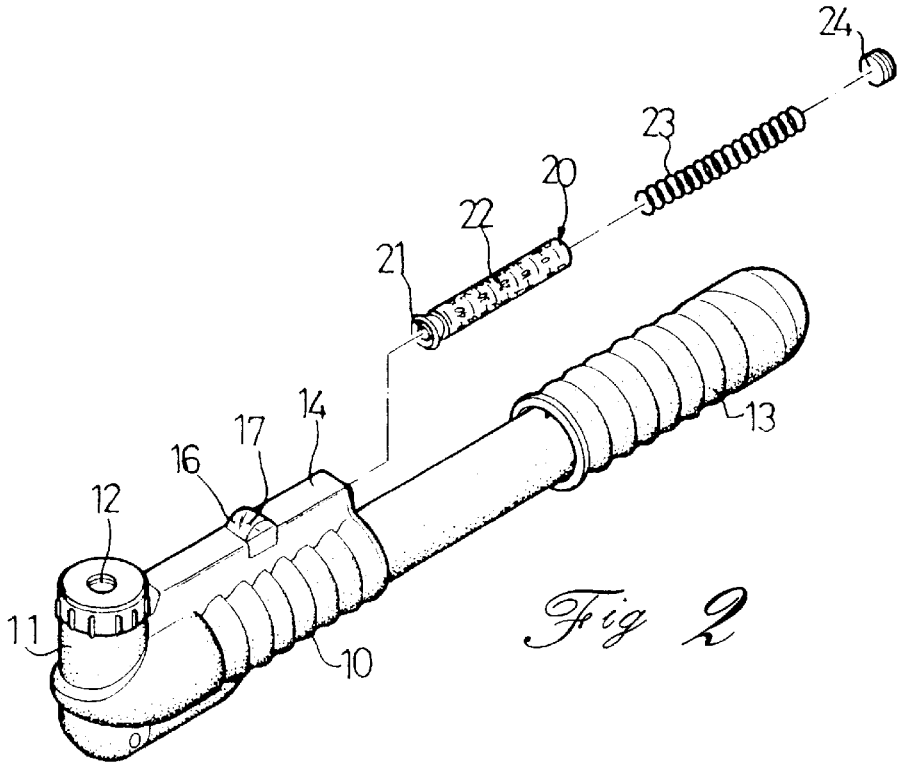
FIG. 2 is an exploded view of a tire pump with a pressure gauge in accordance with the present invention.
Figure 4:
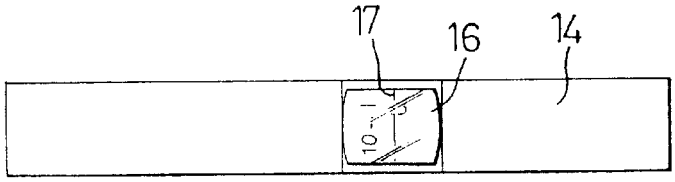
FIG. 4 is a schematic view illustrating tire pressure indication by the pressure gauge in accordance with the present invention.
Figure 3:
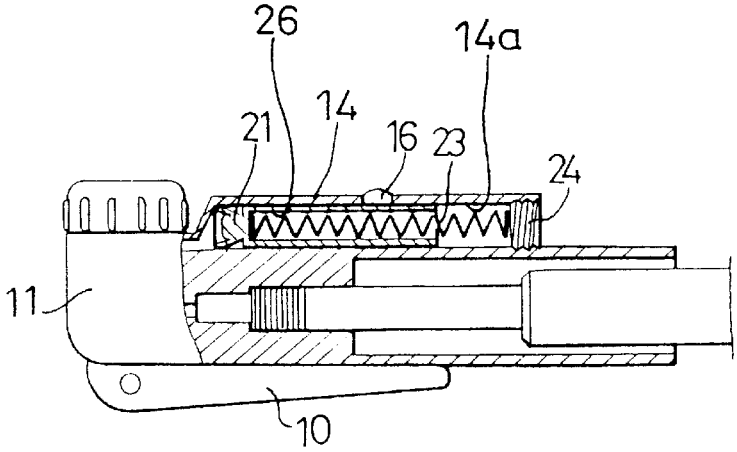
FIG. 3 is a side elevational view, partly in section, of a portion of the tire pump and the pressure gauge in accordance with the present invention.

Referring to FIGS. 2 through 6 and initially to FIGS. 2 and 3, in accordance with the present invention, a pressure gauge for a tire pump comprises a member 14 attached to the body 10 of the pump having a handle 13 and a head 11 through which an outlet 12 is defined. The member 14 defines a chamber 14*a* therein. The chamber 14*a* has a first end which is sealed by an end member 24 such as a bolt, and a second end communicated with the tire pump 10, which is conventional and therefor not described in detail. A window 16 is defined through a peripheral wall of the member 14 and has a line 17 marked on a transparent cover (not labeled) mounted to the window 16.

A pressure indicator includes a tube 20 with a head portion 21 attached to a first end thereof and a receptacle 26 defined in a second end thereof. The head portion 21 is made of rubber so as to be in sealing contact with an inner periphery defining the chamber 14*a*. Preferably, the tube 20 has a circular outer periphery with indicia 22 provided therearound. The indicia 22 may be seen via the window 16. The tire pressure is indicated by relative position between the indicia 22 and the line 17. A spring 23 is attached between the end member 24 and an end wall (not labeled) defining the receptacle 26. During operation of the tire pump, the head portion 21 contacting with the inner periphery of the chamber 14*a* is pushed together with the tube 20 so that the tube 20 with indicia 22 is moved relative to the line 17 on the window 16. It is appreciated that an annular gap 15 is defined between the tube 20 and the inner periphery of the chamber 14*a* so that there will be no friction at all therebetween. Thus, accurate tire pressure indication is obtained.

Figure 6:
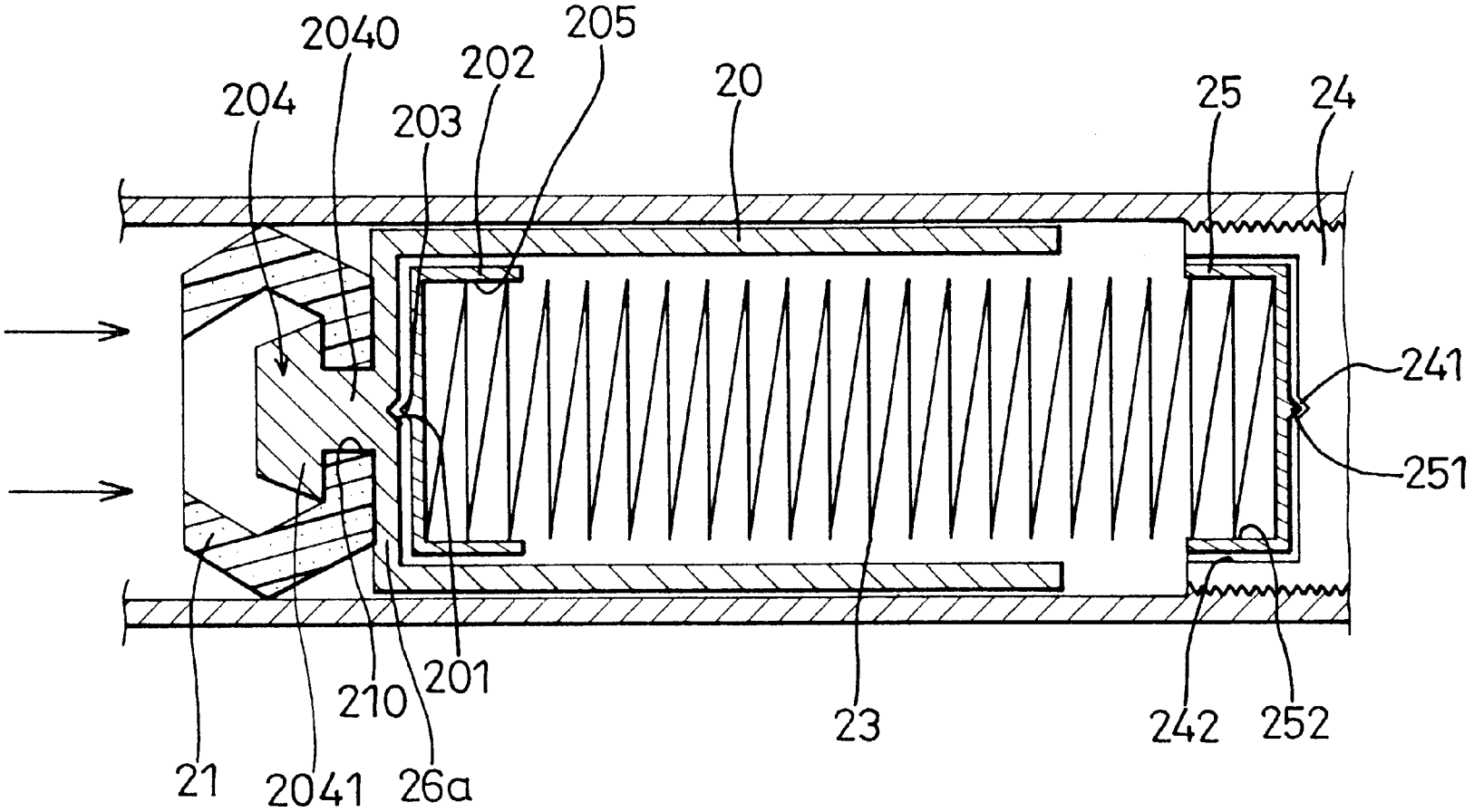
FIG. 6 is a longitudinal sectional view of a second embodiment of the pressure gauge in accordance with the present invention.

FIG. 6 shows a second embodiment of the pressure gauge. In this embodiment, the end wall 26*a* of the receptacle 26 of the tube 20 has a first notch 201 defined therein. A first rotational member 202 is mounted in the receptacle 26 of the tube 20 and has a first tip portion 203 extended therefrom so as to be rotatably received in the first notch 201. A first end of the spring 23 is securely attached to the first rotational member (e.g., securely retained in a compartment 205 of the first rotational member 202) to move therewith (including rotational movement). The end member 24 further has a recess 242 defined in an end facing the tube 20 for receiving a second rotational member 25 therein. A second notch 241 is defined in an end wall defining the recess 242 of the end member 24. The second rotational member 25 is mounted in the recess 242 and has a second tip portion 251 extended therefrom so as to be rotatably received in the second notch 241. A second end of the spring 23 is securely attached to the second retaining member 202 to rotate therewith (e.g., securely retained in a compartment 252 of the second rotational member 25).

The first end of the tube 20 has an engaging member 204 extended therefrom, the engaging member 204 having a neck 2040 from which an enlarged head 2041 extends. The head portion 21 is hollow and has a slit 210 for fittingly receiving the neck 2040. The enlarged head 2041 is retained in the head portion 21 by engaging with an inner periphery of the head portion 21.

By such an arrangement, when the pressure indicator is moved in the chamber 14*a*, the only friction is happened between the head portion 21 and the inner periphery of the chamber 14*a*. The two rotational members 202, 25 may rotate about the two respective tip portions 203, 251 when the spring 23 is compressed so that rotational effect of the spring 23 is eliminated. Therefore, the less friction between the pressure indicator and the inner periphery defining the chamber 14*a* and elimination of the rotational effect of the spring 23 increase tire pressure indication accuracy. It is appreciated that one of the retaining members may be omitted to simplify the structure. In addition, an annular gap (not labeled) is defined between the rotational member 202 and an inner periphery of the tube 20 to prevent rotational friction. Similarly, an annular gap (not labeled) is defined between the rotational member 25 and an inner periphery defining the recess 242 of the end member 24. In an alternative embodiment, the line 17 may be formed on the tube 20 and the indicia 22 may be formed on the window 16.

The invention is not limited to the above embodiment but various modifications thereof may be made. It will be understood by those skilled in the art that various changes in form and detail may made without departing from the scope and spirit of the present invention.

What is claimed is:

1. A pressure gauge of a tire pump, comprising:

a member adapted to be attached to the tire pump and defining a chamber therein, the chamber having a first end which is sealed by an end member, the chamber further having a second end adapted to communicate with said tire pump, a window being defined in the member, and a pressure indicator having a tube with a head portion attached to a first end thereof and a receptacle defined in a second end thereof, indicia being provided around an outer periphery of said tube so as to be seen via said window, a spring being received in the chamber and attached between said end member and an end wall defining said receptacle, said head portion being in slidable contact with an inner periphery of said chamber, and an annular gap being defined between said tube and said inner periphery of said chamber.

2. The pressure gauge as claimed in claim 1, wherein said tube has a circular outer periphery.

3. The pressure gauge as claimed in claim 1, further comprising a rotational member rotatably mounted to the end wall defining said receptacle of said tube, the spring including an end securely attached to the rotational member to move therewith.

4. The pressure gauge as claimed in claim 3, wherein the end wall defining said receptacle of said tube has a notch defined therein, the rotational member including a tip portion rotatably received in said notch.

5. The pressure gauge as claimed in claim 4, wherein the rotational member includes a compartment for securely receiving the end of the spring.

6. The pressure gauge as claimed in claim 3, wherein an annular gap is defined between the rotational member and an inner periphery of said tube.

7. The pressure gauge as claimed in claim 1, further comprising a rotational member rotatably mounted to the end member, the spring including an end securely attached to the rotational member to rotate therewith.

8. The pressure gauge as claimed in claim 7, wherein said end member has a recess with an end wall facing the tube, the end wall of the recess of the end member including a notch defined therein, the rotational member having a tip portion rotatably received in said notch.

9. The pressure gauge as claimed in claim 8, wherein the rotational member includes a compartment for securely receiving the end of the spring.

10. The pressure gauge as claimed in claim 8, wherein an annular gap is defined between the rotational member and an inner periphery defining the recess of the end member.

11. The pressure gauge as claimed in claim 3, further comprising a second rotational member rotatably mounted to the end member, the other end of the spring being securely attached to the second rotational member to rotate therewith.

12. The pressure gauge as claimed in claim 11, wherein said end member has a notch defined in an end facing the tube, the second rotational member having a tip portion rotatably received in said notch.

13. The pressure gauge as claimed in claim 12, wherein the second rotational member includes a compartment for securely receiving the other end of the spring.

14. The pressure gauge as claimed in claim 1, wherein said first end of said tube includes an engaging member extended therefrom for securely engaging with said head portion.

15. The pressure gauge as claimed in claim 14, wherein said head portion has a slit, and wherein said engaging member has a neck from which an enlarged head extends, said neck being securely received in said slit, said enlarged head being retained in the head portion by engaging with an inner periphery of the head portion.

16. A pressure gauge of a tire pump, comprising:

a member adapted to be attached to the tire pump and defining a chamber therein, the chamber having a first end which is sealed by an end member, the chamber further having a second end adapted to communicate with said tire pump, a window being defined in the member and having indicia provided thereon, and a pressure indicator having a tube with a head portion attached to a first end thereof and a receptacle defined in a second end thereof, a line being provided on an outer periphery of said tube so as to be seen via said window for indicating tire pressure, a spring being received in the chamber and attached between said end member and an end wall defining said receptacle, said head portion being in slidable contact with an inner periphery of said chamber, and an annular gap being defined between said tube and said inner periphery of said chamber.

17. The pressure gauge as claimed in claim 16, wherein said tube has a circular outer periphery.

18. The pressure gauge as claimed in claim 17, further comprising a rotational member rotatably mounted to the end wall defining said receptacle of said tube, the spring including an end securely attached to the rotational member to move therewith.

19. The pressure gauge as claimed in claim 16, further comprising a rotational member rotatably mounted to the end member, the spring including an end securely attached to the rotational member to rotate therewith.

* * * * *